US010325540B2

(12) United States Patent
Qin et al.

(10) Patent No.: US 10,325,540 B2
(45) Date of Patent: Jun. 18, 2019

(54) PIXEL STRUCTURE, DISPLAY PANEL AND PIXEL COMPENSATION METHOD THEREFOR

(71) Applicants: Shanghai AVIC Optoelectronics Co., Ltd., Shanghai (CN); Tianma Micro-Electronics Co., Ltd., Shenzhen (CN)

(72) Inventors: Feng Qin, Shanghai (CN); Shoufu Jian, Shanghai (CN); Zhiqiang Xia, Shanghai (CN)

(73) Assignees: Shanghai AVIC Optoelectronics Co., Ltd., Shanghai (CN); Tianma Micro-Electronics Co., Ltd, Shenzhen (CN)

( * ) Notice: Subject to any disclaimer, the term of this patent is extended or adjusted under 35 U.S.C. 154(b) by 624 days.

(21) Appl. No.: 14/722,095

(22) Filed: May 26, 2015

(65) Prior Publication Data

US 2016/0117969 A1 Apr. 28, 2016

(30) Foreign Application Priority Data

Oct. 27, 2014 (CN) ..... 2014 1 0581926

(51) Int. Cl.
*G09G 3/20* (2006.01)

(52) U.S. Cl.
CPC ... *G09G 3/2003* (2013.01); *G09G 2300/0452* (2013.01); *G09G 2300/0465* (2013.01)

(58) Field of Classification Search
None
See application file for complete search history.

(56) References Cited

U.S. PATENT DOCUMENTS 5,587,819 A * 12/1996 Sunohara ..... G02F 1/133514 349/106
6,661,429 B1 * 12/2003 Phan ..... G09G 3/20 345/694

(Continued)

FOREIGN PATENT DOCUMENTS

CN 103278960 A 9/2013
CN 103413515 A 11/2013

(Continued)

OTHER PUBLICATIONS

Cai (CN 103278960 A), Sep. 4, 2013, complete machine translation of the Dec. 28, 2016 IDS reference (Foreign Patent Documents Cite No. 1)*

*Primary Examiner* — Chanh D Nguyen
*Assistant Examiner* — Karin Kiyabu
(74) *Attorney, Agent, or Firm* — Anova Law Group, PLLC

(57) ABSTRACT

A pixel structure including a pixel array is disclosed. The pixel array includes a plurality of pixels, each including a first sub-pixel, a second sub-pixel, and a third sub-pixel. The pixel array also includes a plurality of pixel dots, each including a plurality of sub-pixels from two adjacent rows of sub-pixels in the pixel array, wherein any two of the adjacent rows of sub-pixels in the pixel array are shared by each other. A first pixel dot includes a first sub-pixel and a plurality of surrounding sub-pixels adjacent to the first sub-pixel, wherein at least one or more of the surrounding sub-pixels and the first sub-pixel are shared by each other. In addition, the first pixel dot includes at least four sub-pixels including at least one first sub-pixel, one second sub-pixel, and one third sub-pixel.

8 Claims, 6 Drawing Sheets

(56) References Cited

U.S. PATENT DOCUMENTS 7,123,277 B2 * 10/2006 Brown Elliott ..... G06T 3/4015 345/690
7,184,066 B2 * 2/2007 Elliot ..... G09G 3/20 345/694
7,205,713 B2 * 4/2007 Kiguchi ..... H01L 27/3216 313/498
7,215,347 B2 * 5/2007 Phan ..... G09G 3/2074 345/694
7,221,381 B2 * 5/2007 Brown Elliott ..... G09G 3/20 345/12
7,230,584 B2 * 6/2007 Elliott ..... H04N 9/3114 345/32
7,248,268 B2 * 7/2007 Brown Elliott ..... G09G 5/02 345/589
7,248,314 B2 * 7/2007 Yun ..... G02F 1/133514 349/106
7,268,748 B2 * 9/2007 Brown Elliott ..... H01J 31/20 345/22
7,283,142 B2 * 10/2007 Credelle ..... G09G 3/20 345/589
7,307,646 B2 * 12/2007 Brown Elliott ..... H04N 9/20 345/694
7,372,471 B1 * 5/2008 Hutchins ..... G06T 11/40 345/422
7,420,577 B2 * 9/2008 Brown Elliott ..... G09G 3/3607 345/602
7,505,053 B2 * 3/2009 Brown Elliott ... G02F 1/133514 345/694
7,573,493 B2 * 8/2009 Brown Elliott ... G02F 1/133514 345/426
7,583,279 B2 * 9/2009 Brown Elliott ... G02F 1/133514 345/694
7,701,476 B2 * 4/2010 Brown Elliott ... G02F 1/133514 345/204
7,817,165 B1 * 10/2010 Donham ..... G09G 5/363 345/611
7,920,154 B2 * 4/2011 Brown Elliott ..... G09G 5/02 345/690
7,969,448 B2 * 6/2011 Yang ..... G09G 3/3607 345/581
7,969,456 B2 * 6/2011 Brown Elliott ..... G09G 3/20 345/694
8,081,835 B2 * 12/2011 Brown Elliott ..... G06T 5/009 345/589
8,502,758 B2 * 8/2013 Beland ..... G06F 3/1446 345/55
8,508,548 B2 * 8/2013 Brown Elliott ..... G09G 3/2003 345/613
8,717,255 B2 * 5/2014 Phan ..... G09G 3/2003 345/55
8,786,645 B2 * 7/2014 Gu ..... G09G 3/3607 345/694
8,860,642 B2 * 10/2014 Phan ..... G09G 3/20 345/589
9,164,285 B2 * 10/2015 Whangbo ..... G02B 27/2214
9,165,526 B2 * 10/2015 Gu ..... G09G 5/02
9,257,081 B2 * 2/2016 Nakayama ..... G09F 9/35
9,418,586 B2 * 8/2016 Gu ..... G09G 3/3607
9,489,880 B2 * 11/2016 Lin ..... G09G 3/2003
9,508,296 B2 * 11/2016 Guo ..... G09G 3/3607
9,542,885 B2 * 1/2017 Wang ..... H01L 27/32
9,601,082 B2 * 3/2017 Guo ..... G09G 3/2003
9,679,511 B2 * 6/2017 Gu ..... G09G 3/2074
9,697,760 B2 * 7/2017 Wang ..... G09G 3/2003
9,734,745 B2 * 8/2017 Gu ..... G09G 3/3607
9,779,645 B2 * 10/2017 Guo ..... G09G 3/20
9,922,604 B2 * 3/2018 He ..... G09G 3/3607
9,946,123 B2 * 4/2018 Huangfu ..... G02F 1/134336
9,978,321 B2 * 5/2018 Tsuruma ..... G02F 1/13
2002/0015041 A1 * 2/2002 Naegle ..... G06F 7/509 345/501
2003/0034992 A1 * 2/2003 Brown Elliott ..... G06T 3/4015 345/690
2003/0076331 A1 * 4/2003 Deering ..... G06T 15/80 345/581
2003/0085906 A1 * 5/2003 Elliott ..... G09G 3/20 345/613
2003/0103058 A1 * 6/2003 Brown Elliott ..... G09G 3/20 345/589
2003/0122815 A1 * 7/2003 Deering ..... G06T 5/20 345/419
2003/0218618 A1 * 11/2003 Phan ..... G09G 3/2074 345/629
2004/0051724 A1 * 3/2004 Elliott ..... G02F 1/133514 345/694
2004/0113875 A1 * 6/2004 Miller ..... G09G 3/3216 345/82
2004/0150651 A1 * 8/2004 Phan ..... G09G 3/2003 345/589
2004/0161146 A1 * 8/2004 Van Hook ..... H04N 1/644 382/166
2004/0212633 A1 * 10/2004 Natori ..... G09F 9/33 345/694
2004/0234163 A1 * 11/2004 Lee ..... G06T 3/4092 382/298
2005/0082990 A1 * 4/2005 Elliott ..... G02B 26/008 315/364
2005/0099378 A1 * 5/2005 Kim ..... G02F 1/134309 345/99
2005/0099540 A1 * 5/2005 Elliott ..... G06T 3/4023 348/458
2005/0122294 A1 * 6/2005 Ben-David ..... G09G 3/2003 345/87
2005/0140907 A1 * 6/2005 Yun ..... G02F 1/133514 349/144
2005/0225575 A1 * 10/2005 Brown Elliott ... G02F 1/133514 345/694
2006/0044294 A1 * 3/2006 Dannera-Venkata ..... G09G 3/007 345/204
2006/0158466 A1 * 7/2006 Chien ..... G09G 3/2074 345/694
2007/0052887 A1 * 3/2007 Brown Elliot .... G02F 1/133514 349/108
2007/0064020 A1 * 3/2007 Credelle ..... G09G 3/2003 345/694
2007/0070086 A1 * 3/2007 Brown Elliott ..... G09G 5/02 345/613
2008/0030526 A1 * 2/2008 Brown Elliott ..... G09G 3/20 345/694
2008/0225143 A1 * 9/2008 Joffer ..... G09G 3/2003 348/280
2008/0292207 A1 * 11/2008 Kang ..... G06T 5/008 382/274
2009/0058873 A1 * 3/2009 Brown Elliott ..... G06T 5/009 345/589
2010/0118045 A1 * 5/2010 Brown Elliott .... G02B 27/2214 345/589
2010/0164978 A1 * 7/2010 Brown Elliott ... G02F 1/133514 345/600
2011/0043533 A1 * 2/2011 Han ..... G09G 5/02 345/589
2011/0043553 A1 * 2/2011 Brown Elliott ..... G09G 3/3406 345/694
2011/0127506 A1 * 6/2011 So ..... H01L 27/3213 257/40
2011/0140999 A1 * 6/2011 Beland ..... G06F 3/1446 345/82
2012/0113069 A1 * 5/2012 Kwon ..... G09G 3/2074 345/204
2012/0206512 A1 * 8/2012 Kim ..... G02F 1/133514 345/691
2012/0287168 A1 * 11/2012 Botzas ..... G09G 3/3413 345/690
2013/0027437 A1 * 1/2013 Gu ..... G09G 3/3607 345/690

(56) References Cited

U.S. PATENT DOCUMENTS

2013/0234917 A1* 9/2013 Lee ..... H01L 27/3218 345/82
2013/0241946 A1* 9/2013 Jeong ..... G09G 3/2074 345/589
2014/0104301 A1 4/2014 Nakagawa et al.
2014/0152714 A1* 6/2014 Nakagawa ..... H04N 9/67 345/690
2014/0300626 A1* 10/2014 Gu ..... G09G 3/3607 345/600
2015/0029208 A1* 1/2015 Kim ..... G09G 3/2003 345/590
2015/0302814 A1* 10/2015 Shiomi ..... G09G 3/3607 345/694
2015/0348470 A1* 12/2015 Wang ..... G02B 5/201 345/694
2015/0364525 A1* 12/2015 Lin ..... H01L 27/3213 257/40
2015/0379916 A1* 12/2015 Guo ..... G02F 1/136286 345/694
2015/0380471 A1* 12/2015 Guo ..... G09G 3/20 345/76
2016/0005382 A1* 1/2016 Guo ..... G09G 3/2003 345/694
2016/0027362 A1* 1/2016 Guo ..... G09G 3/2003 345/690
2016/0035263 A1* 2/2016 Guo ..... G02F 1/1362 345/593
2016/0041434 A1* 2/2016 Qin ..... G02F 1/134309 345/694
2016/0055780 A1* 2/2016 Guo ..... G09G 3/2003 345/55
2016/0063908 A1* 3/2016 Lin ..... G09G 3/2003 345/694
2016/0217726 A1* 7/2016 Guo ..... G09G 3/2003
2016/0247433 A1* 8/2016 Guo ..... G09G 3/20
2016/0253943 A1* 9/2016 Wang ..... G09G 3/2003 345/694
2016/0275858 A1* 9/2016 Wang ..... H01L 27/32
2017/0039918 A1* 2/2017 Tsao ..... G09G 3/2003
2018/0041779 A1* 2/2018 Zhang ..... H04N 19/117
2018/0063527 A1* 3/2018 Chen ..... H04N 19/117

FOREIGN PATENT DOCUMENTS

CN 103714775 A 4/2014
CN 103777393 A 5/2014
CN 104036710 A 9/2014
DE 602005004726 T2 2/2009
KR 10-2009-0057705 A 6/2009

* cited by examiner

201

| | | | | | | |
|---|---|---|---|---|---|---|
| P1 | SP1 | SP2 | SP3 | SP1 | SP2 | SP3 |
| P2 | SP3 | SP1 | SP2 | SP3 | SP1 | SP2 |
| P1 | SP1 | SP2 | SP3 | SP1 | SP2 | SP3 |
| P2 | SP3 | SP1 | SP2 | SP3 | SP1 | SP2 |

*FIG. 3*

201

| | | | | | | |
|---|---|---|---|---|---|---|
| P1 | SP1 | SP2 | SP3 | SP1 | SP2 | SP3 |
| P3 | SP2 | SP3 | SP1 | SP2 | SP3 | SP1 |
| P1 | SP1 | SP2 | SP3 | SP1 | SP2 | SP3 |
| P3 | SP2 | SP3 | SP1 | SP2 | SP3 | SP1 |

*FIG. 4*

PIXEL STRUCTURE, DISPLAY PANEL AND PIXEL COMPENSATION METHOD THEREFOR

CROSS-REFERENCES TO RELATED APPLICATIONS

This application claims the benefit of priority to Chinese Patent Application No. 201410581926.4 filed on Oct. 27, 2014 and entitled "PIXEL STRUCTURE, DISPLAY PANEL AND PIXEL COMPENSATION METHOD THEREFOR", the content of which is incorporated herein by reference in its entirety.

BACKGROUND OF THE INVENTION

Display panels have been widely applied at present to a handset, a Personal Digital Assistant (PDA) and other portable electronic products, e.g., a Thin Film Transistor Liquid Crystal Display (TFT-LCD), an Organic Light Emitting Diode (OLED), a Low Temperature Poly-Silicon (LTPS) display, a Plasma Display Panel (PDP), etc. In recent years, display devices with a superior display effect and a better visual effect have become increasingly favored due to their competition for the market.

A display panel consists of a plurality of pixels, and in order to enable each single pixel to display various colors, the single pixel 101 which is a color pixel is divided into three smaller sub-pixels 102 in red, green and blue in a pixel structure as illustrated in FIG. 1. That is, the three sub-pixels are integrated together. In order to display different colors, the three sub-pixels 102 emit light respectively at different luminances and are visually mixed into a desirable color due to a very small size of the three sub-pixels 102. In the existing display panel, a pixel is equally divided into three sub-pixels, each of which is assigned with a different color, thus resulting in a color pixel.

As the display panel needs to display a picture better, the Pixel Per Inch (PPI) thereof has to be constantly improved accordingly, thus greatly lowering the transmittance of the display panel. Moreover a larger number of data lines and scanning lines required for the display panel with the high pixel per inch may come with a higher cost thereof.

BRIEF DESCRIPTION OF THE DRAWINGS

In order to make the technical solutions according to the embodiments of the application more apparent, the drawings to which reference is made will be described briefly below in the description of the embodiments, and evidently the drawings in the following description are illustrative of only some of the embodiments of the application, and those ordinarily skilled in the art can further derive other drawings from these drawings without any inventive effort.

FIG. 3 illustrates a schematic diagram of another pixel structure according to an embodiment of the application;

FIG. 4 illustrates a schematic diagram of a third pixel structure according to an embodiment of the application;

DETAILED DESCRIPTION OF THE PREFERRED EMBODIMENTS

The technical solutions according to the embodiments of the application will be described below clearly and fully with reference to the drawings in the embodiments of the application, and evidently the embodiments described here are only a part but not all of the embodiments of the application. All the other embodiments which can occur to those ordinarily skilled in the art based upon the embodiments here of the application without any inventive effort shall fall into the scope of the application as claimed.

An embodiment of the application provides a pixel structure including a pixel array. The pixel array includes a plurality of pixels, each of which includes a first sub-pixel, a second sub-pixel and a third sub-pixel in different colors including any permutation and combination of red, blue and green.

Any two adjacent rows of sub-pixels in the pixel array are shared by each other and constitute a plurality of pixel dots, a first pixel dot includes a first sub-pixel and several surrounding sub-pixels adjacent to the first sub-pixel, and at least one or more of the surrounding sub-pixels and the first sub-pixel are shared by each other; and the first pixel dot includes at least one first sub-pixel, second sub-pixel and third sub-pixel, and the first pixel dot includes at least four sub-pixels.

Figure 2:
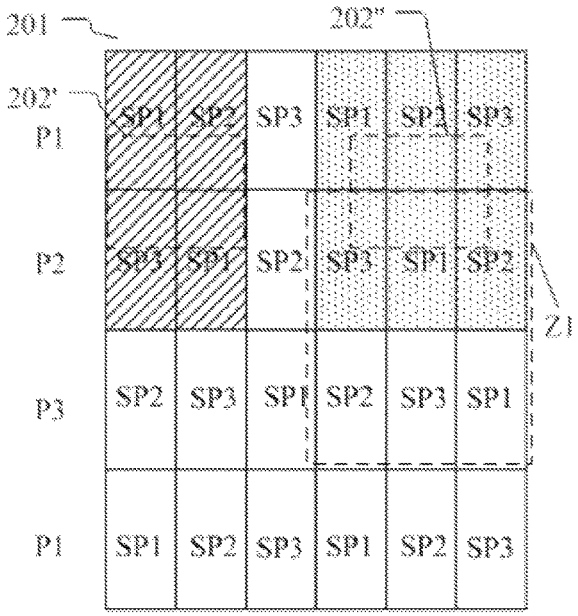
FIG. 2 illustrates a schematic diagram of a pixel structure according to an embodiment of the application.

As illustrated in FIG. 2, the pixel array 201 includes a plurality of first pixel rows P1, second pixel rows P2 and third pixel rows P3, where the first pixel row P1 includes a row of the first sub-pixel SP1, the second sub-pixel SP2 and the third sub-pixel SP3 arranged in that repeated order, the second pixel row P2 includes a row of the third sub-pixel SP3, the first sub-pixel SP1 and the second sub-pixel SP2 arranged in that repeated order, and the third pixel row P3 includes a row of the second sub-pixel SP2, the third sub-pixel SP3 and the first sub-pixel SP1 arranged in that repeated order; and the plurality of sub-pixels are arranged linearly in both the row direction and the column direction.

The above-described embodiment is only one of the embodiments of the application. Alternatively, the first pixel row P1, the second pixel row P2 and the third pixel row P3 in the pixel array can be arranged in various permutations and combinations but will not be limited to the structure illustrated in FIG. 2 as long as two adjacent rows of sub-pixels are different pixel rows.

Figure 5:
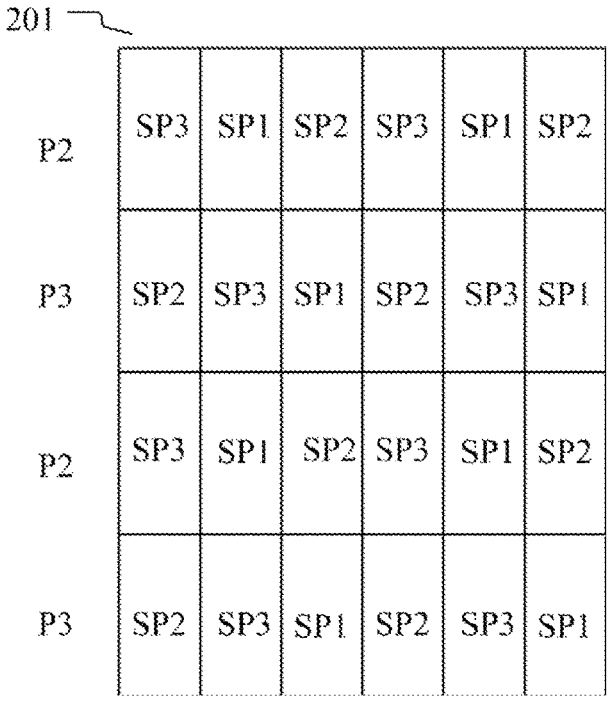
FIG. 5 illustrates a schematic diagram of a fourth pixel structure according to an embodiment of the application.
Figure 6:
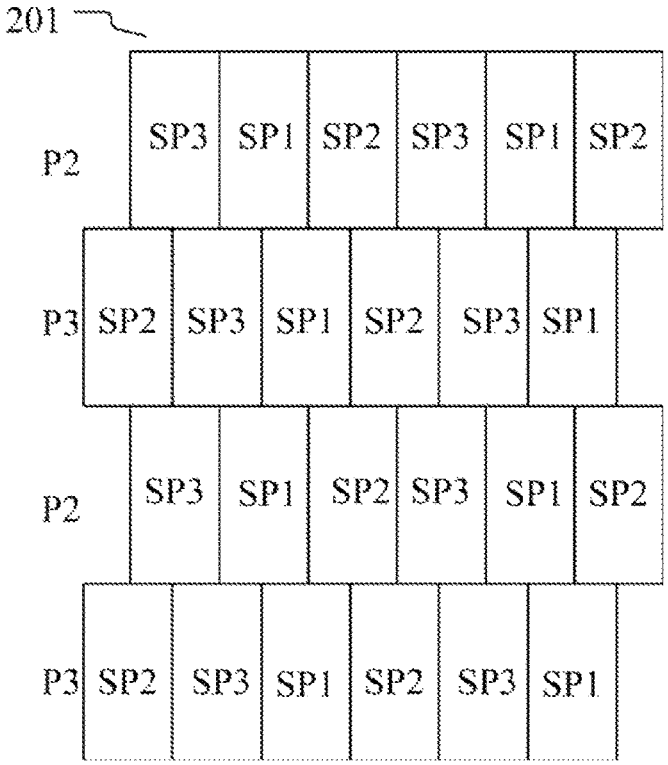
FIG. 6 illustrates a schematic diagram of a fifth pixel structure according to an embodiment of the application.

The above-described embodiment is only one of the embodiments of the application. Alternatively, an alternative structure may be possible as illustrated in FIG. 3 where the pixel array includes a plurality of first pixel rows and second pixel rows arranged alternately throughout the pixel structure; or as illustrated in FIG. 4 where the pixel array includes a plurality of first pixel rows and third pixel rows arranged alternately throughout the pixel structure; or as illustrated in FIG. 5 where the pixel array includes a plurality of second pixel rows and third pixel rows arranged alternately throughout the pixel structure; or as illustrated in FIG. 6 where the plurality of sub-pixels can alternatively be arranged zigzag in the column direction, and the horizontal offset between the adjacent rows of sub-pixels is half the length of the sub-pixels in the direction of the rows of sub-pixels.

This embodiment has been described in connection with a number of patterns in which the pixel array is arranged, and accordingly there may be more patterns in which the pixels are shared and displayed.

Figure 1:
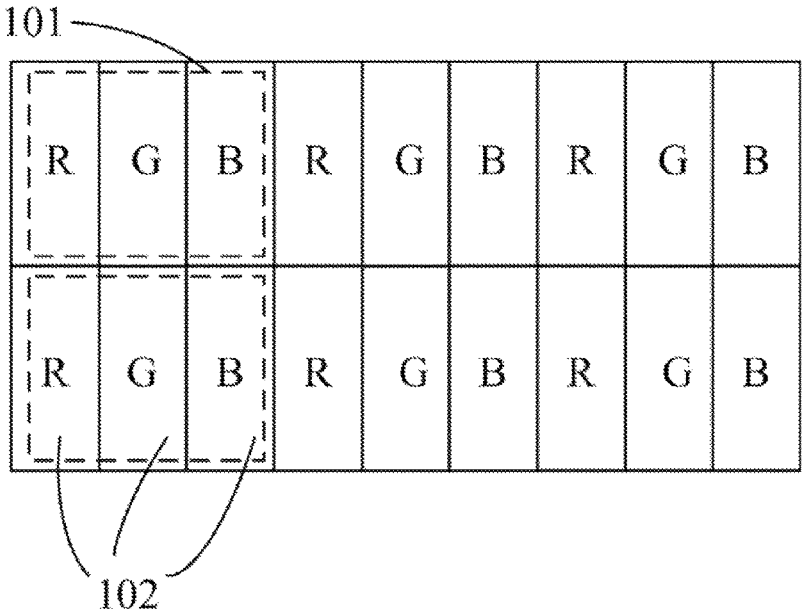
FIG. 1 illustrates a schematic diagram of a pixel structure in the prior art.
Figure 7:
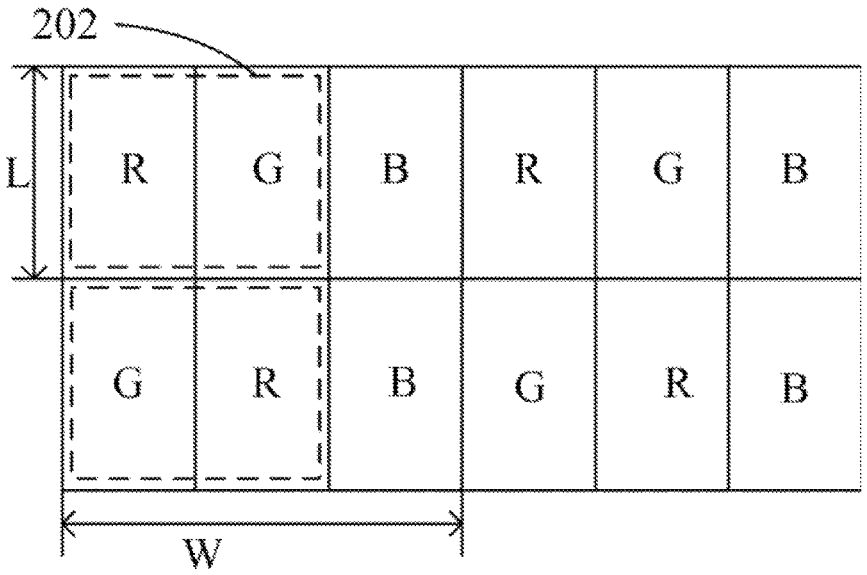
FIG. 7 illustrates a schematic diagram of a sixth pixel structure according to an embodiment of the application.

Referring to FIG. 1 and FIG. 7, in the embodiments of the application, such a virtual pixel dot solution is implemented that in the case of a lower number of physical sub-pixels on a display panel, each sub-pixel is shared by sub-pixels surrounding the sub-pixel at least once, and when each sub-pixel is shared and the number of physical sub-pixels is lowered, the length of the physical sub-pixels remains unchanged, but only the width of the sub-pixels is extended, as illustrated in FIG. 7; and in the case that the length of the sub-pixels remains unchanged, as illustrated in FIG. 1, given the pixel per inch, defined as A, in the pixel array of the display panel with the same width as in FIG. 7, no sub-pixels will be shared in a conventional process and algorithm, and the width of the desirable repeated unit including the red sub-pixel, the green sub-pixel and the blue sub-pixel at this time is defined as y, where the repeated unit is a square, and a relationship between the pixel per inch A and the width y of the repeated unit can be derived by calculating the Pixel Per Inch (PPI) as follows:

$A=C/y$, where $C$ represents a constant, and $C$ is 1 inch;

In the conventional process and algorithm, when no sub-pixels is shared, the desirable repeated unit including the red sub-pixel, the green sub-pixel and the blue sub-pixel is a virtual pixel dot as defined according to the embodiment of the application, where the width of the virtual pixel dot is y; as illustrated in FIG. 1 and FIG. 7, there is a uniform length L of a single sub-pixel, and there are different widths W of three consecutive sub-pixels in these two figures, where the width of the sub-pixels in FIG. 7 is extended; and the virtual pixel dot 202 in FIG. 7 is shaped and sized the same as the color pixel 101 in FIG. 1, and in FIG. 7, each sub-pixel is shared by each other to thereby display a virtual pixel dot as a full pixel, so that each sub-pixel can be shared by sub-pixels surrounding the sub-pixel to thereby achieve a desirable higher Pixel Per Inch (PPI) despite the lower number of physical sub-pixels in FIG. 7 than in FIG. 1.

Where the number of times that a single sub-pixel is shared is calculated according to the varying pattern in which the virtual pixel dots are arranged in the pixel array. As can be apparent from FIG. 2, two adjacent rows P1 and P2 constitute a first pixel dot, and if the first pixel dot includes the first sub-pixel SP1 and several surrounding sub-pixels adjacent to the first sub-pixel SP1, as illustrated by the biases in FIG. 2, then at least one or more of the surrounding sub-pixels and the first sub-pixel are shared by each other; the first pixel dot represented as the biases includes the first sub-pixel SP1, the second sub-pixel SP2, the first sub-pixel SP1 and the third sub-pixel SP3 arranged clockwise, and the first pixel dot is a 2×2 matrix of sub-pixels; and at this time a virtual pixel dot 202' in the first pixel dot includes halves of the respective sub-pixels arranged clockwise, and the other halves of the respective sub-pixels are shared by another virtual pixel dot to display, and at this time each sub-pixel is shared twice. If the first pixel dot includes the first sub-pixel SP1, the second sub-pixel SP2, the third sub-pixel SP3, the second sub-pixel SP2, the first sub-pixel SP1 and the third sub-pixel SP3 arranged clockwise as illustrated by the shades in FIG. 2, and the first pixel dot is a 2×3 matrix of sub-pixels; and at this time a virtual pixel dot 202" in the first pixel dot includes parts of the respective sub-pixels arranged clockwise, and the respective sub-pixels and sub-pixels in second pixel dot Z1 surrounding the first pixel dot are shared by each other, and at this time each sub-pixel is shared for a varying number of times, which may be 2 or 4. Actually no virtual pixel dots can be visible while a display device including the pixel structure is displaying, but the number of times that the pixels are shared needs to be calculated by determining the size of the virtual pixel dots and the pattern in which they are arranged. The number of sub-pixels of the first pixel dot and the second pixel dot can be determined and the number of times that a single sub-pixel is shared can be decided, according to the number of sub-pixels in the virtual pixel dot.

Referring to FIG. 2, in the pixel array according to the embodiment of the application, in order to achieve some requirement for Pixel Per Inch (PPI), each virtual pixel dot does not include three physical sub-pixels but includes only a part of zones of several adjacent or proximate sub-pixels, that is, each sub-pixel is divided into several zones, each of which is a virtual sub-pixel of a different pixel dot; and in the structure of the pixel array, there are a number x of virtual pixel dots in the first sub-pixel SP1, the second sub-pixel SP2 and the third sub-pixel SP3 arranged consecutively, where $1<x\leq 3$, and given the width W of the repeated unit of the first sub-pixel SP1, the second sub-pixel SP2 and the third sub-pixel SP3, in the case that there is a uniform length of each sub-pixel, which is a unit length of 1 micrometer, if the length of a single virtual pixel dot is also a unit length of 1 micrometer, then a relationship between the width of the repeated unit of three sub-pixels and the width y of a single virtual pixel dot can be defined as follows:

$W=xy,$

Where $y=C/A$, and $1<x\leq 3$;

In the pixel array in this case, the ratio of the length to the width of a single sub-pixel is 3: W, i.e., 3A: Cx; and the panel including the pixel array including the shared pixels at a desirable PPI can be designed according to this ratio.

According to this embodiment of the application, it is provided the relationship between the pixel per inch and the ratio of the length to the width of a single sub-pixel, and in the design of the real panel, the pattern in which the pixels of the real panel are arranged and their sizes can be obtained simply by calculating the desirable PPI.

Figure 8:
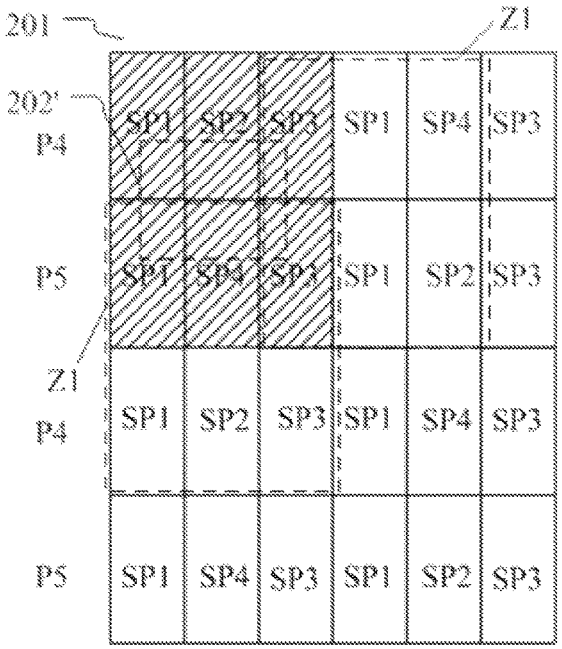
FIG. 8 illustrates a schematic diagram of a seventh pixel structure according to an embodiment of the application.

The above-described embodiment is only one of the embodiments of the application. Alternatively, as illustrated in FIG. 8, the pixel array includes a plurality of fourth pixel rows P4 and fifth pixel rows P5. The fourth pixel row P4 includes a row of the first sub-pixel SP1, the second sub-pixel SP2, the third sub-pixel SP3, the first sub-pixel SP1, the fourth sub-pixel SP4 and the third sub-pixel SP3 arranged in that repeated order, and the fifth pixel row P5 includes a row of the first sub-pixel SP1, the fourth sub-pixel SP4, the third sub-pixel SP3, the first sub-pixel SP1, the second sub-pixel SP2 and the third sub-pixel SP3 arranged in that repeated order, where the four sub-pixels are in different colors; and the fourth sub-pixel SP4 can be white sub-pixel or yellow sub-pixel, and the fourth pixel rows P4 and the fifth pixel rows P5 are arranged alternately in the pixel array. In the pixel array, since any two adjacent rows of sub-pixels are shared by each other, and the first pixel dot includes at least one first sub-pixel, second sub-pixel and third sub-pixel, thus the first pixel dot is a 2×3 matrix of sub-pixels, the virtual pixel dot includes parts of the respective sub-pixels in the first pixel dot, and the sub-pixels in the first pixel dot and sub-pixels in second pixel dot Z1 surrounding the first pixel dot are shared by each other. The virtual pixel dot can be arranged at different locations to thereby change the number of sub-pixels in the first pixel dot and also the number of times that the sub-pixels are shared. Moreover the plurality of sub-pixels are arranged linearly in both the row direction and the column direction.

Figure 9:
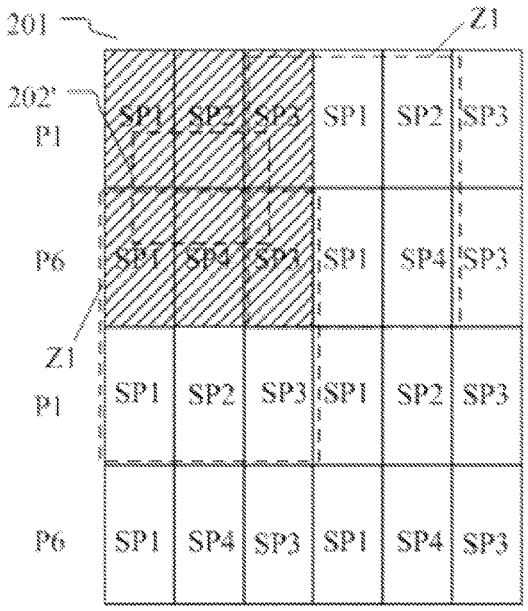
FIG. 9 illustrates a schematic diagram of an eighth pixel structure according to an embodiment of the application.

The above-described embodiment is only one of the embodiments of the application. Alternatively, as illustrated in FIG. 9, the pixel array includes a plurality of first pixel rows P1 and sixth pixel rows P6, where the first pixel row P1 includes a row of the first sub-pixel SP1, the second sub-pixel SP2 and the third sub-pixel SP3 arranged in that repeated order, and the sixth pixel row P6 includes a row of the first sub-pixel SP1, the fourth sub-pixel SP4 and the third sub-pixel SP3 arranged in that repeated order, where the four sub-pixels are in different colors; and the fourth sub-pixel SP4 can be white sub-pixel or yellow sub-pixel, and the first pixel rows P1 and the sixth pixel rows P6 are arranged alternately in the pixel array. In the pixel array, any two adjacent rows of sub-pixels are shared by each other.

The above-described embodiment is only one of the embodiments of the application. Alternatively, the plurality of sub-pixels can be arranged zigzag in the column direction, and the horizontal spacing between the adjacent rows of sub-pixels is half the length in the direction of the rows of sub-pixels.

Figure 10:
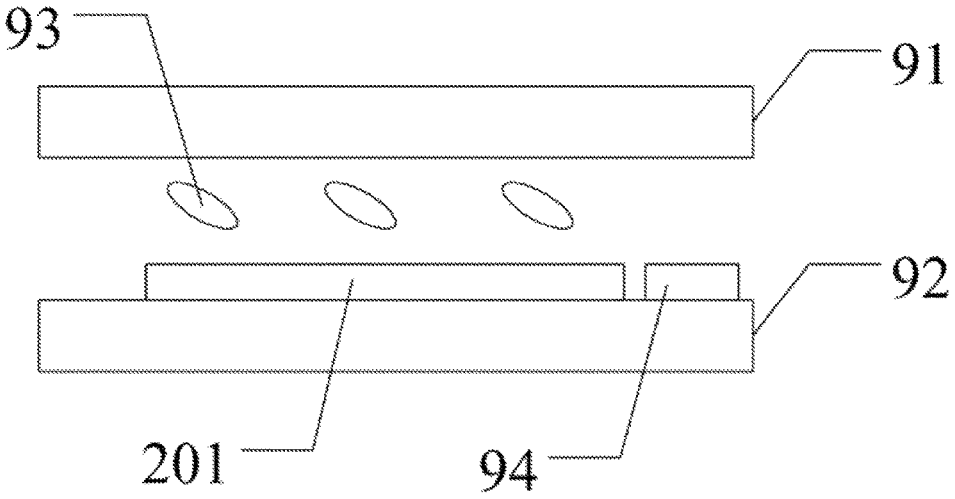
FIG. 10 is a structural schematic diagram of a display panel according to an embodiment of the application.

An embodiment of the application provides a display panel including a plurality of the pixel structures described above, and a signal driver. As illustrated in FIG. 10, the display panel includes a first substrate 91, a second substrate 92, and liquid crystal molecules 93 arranged between the two substrates, there are a pixel array 201 and a signal driver 94 on the second substrate 92, and the signal driver 94 is configured to provide sub-pixels in the pixel array with a display signal while the display panel is displaying.

An embodiment of the application further provides a pixel compensation method for a display panel, applicable to the pixel structure described above, where the method includes:

Sharing at least one or more of the surrounding sub-pixels and the first sub-pixel;

Providing the first pixel dot with several sub-pixels in the same color, where the total luminance of the several sub-pixels in the same color is provided evenly by the several sub-pixels in the same color, and the total luminance of the several sub-pixels in the same color is the sum of the luminances of the several sub-pixels in the same color;

Providing sub-pixels in respective colors in the first pixel dot with the total luminance at a uniform ratio thereof to the highest luminance of each sub-pixel in the respective colors, such that for each color, the ratio of the highest luminance of the sub-pixels to the total luminance of the sub-pixels is the same as the corresponding ratio for the other colors;

Providing several further second pixel dots adjacent to the first pixel dot to surround the first pixel dot, so that the sub-pixels in the first pixel dot and sub-pixels in the second pixel dots are shared by each other; and Inputting, by the signal driver, a signal to each sub-pixel for displaying in the displaying process of the display panel, wherein the input signal is configured to control display luminance of the sub-pixel, the display luminance of each sub-pixel is a sum of a luminance of the sub-pixel in the first pixel dot and a luminance of the sub-pixel in the second pixel dot, wherein the display luminance of each sub-pixel is the highest or maximum luminance thereof.

The display luminance of each sub-pixel is limited to the highest or maximum luminance available to each sub-pixel.

Where a single sub-pixel in the pixel structure is shared twice or four times.

Figure 11:
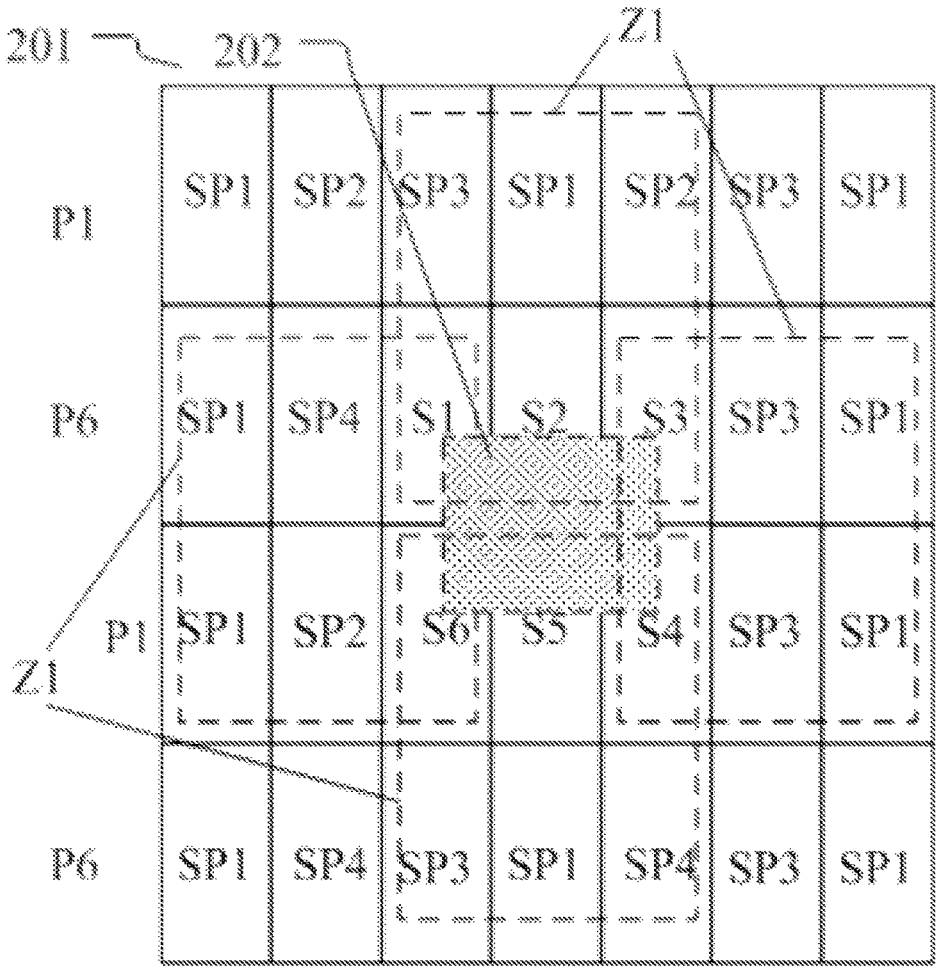
FIG. 11 illustrates a schematic diagram of a ninth pixel structure according to an embodiment of the application.

Particularly as can be apparent from FIG. 11, the first pixel dot is a 2×3 matrix of sub-pixels, there is a virtual pixel dot 202 in the first pixel dot, the first pixel dot includes the sub-pixels S1, S2, S3, S4, S5 and S6 arranged clockwise, the virtual pixel dot 202 includes parts of these six sub-pixels, and there are four second pixel dots Z1, surrounding the first pixel dot, with their sub-pixels being shared with the first pixel dot, where the sub-pixels S1, S3, S4 and S6 in the first pixel dot are shared respectively with three surrounding second pixel dots, so each of the sub-pixels S1, S3, S4 and S6 is shared for four times; and the sub-pixels S2 and S5 in the first pixel dot are shared respectively with one surrounding second pixel dot, so each of the sub-pixels S2 and S5 is shared twice.

With the pixel structure, the display panel including the pixel structure, and the pixel compensation method for the display panel according to the embodiments of the application, such a virtual pixel dot solution is implemented that each virtual pixel dot does not include three physical sub-pixels but includes only a part of zones of several adjacent or proximate sub-pixels, that is, each sub-pixel is divided into several zones, each of which is a virtual sub-pixel of a different pixel dot; and in the case of a lower number of physical sub-pixels on the display panel, each sub-pixel and surrounding the sub-pixel are shared by each other at least once, thus improving the Pixel Per Inch (PPI) and optimizing a display effect.

The pixel structure, the display panel including the pixel structure, and the pixel compensation method for the display panel according to the embodiments of the application have been described above in details, and the principle of the application and the embodiments thereof have been set forth in this context by way of several examples, but the embodiments above have been described only for the purpose of facilitating understanding of the method of the application and the core idea thereof; and moreover those ordinarily skilled in the art can modify the embodiments and application scopes of the application without departing from the spirit of the application, and in summary the disclosure of the application will not be construed as limiting the application.

What is claimed is:

1. A pixel structure comprising:

a pixel array, wherein the pixel array comprises a plurality of pixels, each comprising a first sub-pixel, a second sub-pixel, and a third sub-pixel; and a plurality of pixel dots, each comprising a plurality of sub-pixels from two adjacent rows of sub-pixels in the pixel array, wherein the sub-pixels in any two of the adjacent rows of sub-pixels in the pixel array are shared by the any two of the adjacent rows of sub-pixels in the pixel array, wherein the plurality of pixel dots includes a first pixel dot and a plurality of second pixel dots adjacent to the first pixel dot, the first pixel dot includes a 2×3 matrix of sub-pixels and each of the plurality of second pixel dots includes a 2×3 matrix of sub-pixels, wherein the 2×3 matrix of sub-pixels of the first pixel dot includes two sub-pixels and four sub-pixels, each of the two sub-pixels is shared by a single second pixel dot of the plurality of second pixel dots, and each of the four sub-pixels is shared by three second pixel dots of the plurality of second pixel dots, wherein the pixel array includes a plurality of first pixel rows, a plurality of second pixel rows and a plurality of third pixel rows, wherein a first pixel row comprises a row of the first sub-pixel, the second sub-pixel, and a third sub-pixel, arranged in that repeated order, the second pixel row comprises a row of the third sub-pixel, the first sub-pixel, and the second sub-pixel arranged in that repeated order, and a third pixel row comprises a row of the second sub-pixel, the third sub-pixel, and the first sub-pixel arranged in that repeated order, wherein in the pixel array, the first sub-pixel, the second sub-pixel and the third sub-pixel that are consecutively arranged in one of the first, the second and the third pixel rows include X number of virtual pixel dots and have a width of W, each sub-pixel has a length of one unit length, each of the X number of the virtual pixel dots has a length of one unit length and a width of Y, and $W=X*Y$, where $Y=C/A$, C denotes a constant which is 1 inch, A denotes pixel per inch, and $1<X\leq 3$, wherein each sub-pixel in the first pixel dot is shared by at least two virtual pixel dots, and each virtual pixel dot, containing a plurality of virtual sub-pixels, includes a partial portion of the first sub-pixel, the second sub-pixel and the third sub-pixel that are consecutively arranged, and wherein each sub-pixel in the first pixel dot includes a plurality of portions, each of the plurality of portions including a virtual sub-pixel corresponding to one of the plurality of second pixel dots adjacent to the first pixel dot.

2. The pixel structure according to claim 1, wherein the first sub-pixel, the second sub-pixel, and the third sub-pixel are sub-pixels of different colors.

3. The pixel structure according to claim 2, wherein the plurality of sub-pixels are arranged linearly in the row direction.

4. The pixel structure according to claim 3, wherein the plurality of sub-pixels are arranged linearly in the column direction.

5. The pixel structure according to claim 1, wherein the first, second, and third sub-pixels are respectively red, green, and blue sub-pixels arranged in a varying order.

6. A display panel, comprising:

a plurality of pixel structures; and a signal driver, wherein each pixel structure of the plurality of pixel structures comprises:

a pixel array, wherein the pixel array comprises a plurality of pixels, each comprising a first sub-pixel, a second sub-pixel, and a third sub-pixel; and a plurality of pixel dots, each comprising a plurality of sub-pixels from two adjacent rows of sub-pixels in the pixel array, wherein the sub-pixels in any two of the adjacent rows of sub-pixels in the pixel array are shared by the any two of the adjacent rows of sub-pixels in the pixel array, wherein the plurality of pixel dots includes a first pixel dot and a plurality of second pixel dots adjacent to the first pixel dot, the first pixel dot includes a 2×3 matrix of sub-pixels and each of the plurality of second pixel dots includes a 2×3 matrix of sub-pixels, wherein the 2×3 matrix of sub-pixels of the first pixel dot includes two sub-pixels and four sub-pixels, each of the two sub-pixels is shared by a single second pixel dot of the plurality of second pixel dots, and each of the four sub-pixels is shared by three second pixel dots of the plurality of second pixel dots, wherein the pixel array includes a plurality of first pixel rows, a plurality of second pixel rows and a plurality of third pixel rows, wherein a first pixel row comprises a row of the first sub-pixel, the second sub-pixel, and a third sub-pixel, arranged in that repeated order, the second pixel row comprises a row of the third sub-pixel, the first sub-pixel, and the second sub-pixel arranged in that repeated order, and a third pixel row comprises a row of the second sub-pixel, the third sub-pixel, and the first sub-pixel arranged in that repeated order, wherein in the pixel array, the first sub-pixel, the second sub-pixel and the third sub-pixel that are consecutively arranged in one of the first, the second and the third pixel rows include X number of virtual pixel dots and have a width of W, each sub-pixel has a length of one unit length, each of the X number of the virtual pixel dots has a length of one unit length and a width of Y, and $W=X*Y$, where $Y=C/A$, C denotes a constant which is 1 inch, A denotes pixel per inch, and $1<X\leq 3$, wherein each sub-pixel in the first pixel dot is shared by at least two virtual pixel dots, and each virtual pixel dot, containing a plurality of virtual sub-pixels, includes a partial portion of the first sub-pixel, the second sub-pixel and the third sub-pixel that are consecutively arranged, and wherein each sub-pixel in the first pixel dot includes a plurality of portions, each of the plurality of portions including a virtual sub-pixel corresponding to one of the plurality of second pixel dots adjacent to the first pixel dot.

7. A pixel compensation method for a display panel, applicable to a pixel structure comprising a pixel array, wherein the pixel array comprises: a plurality of pixels, each comprising a first sub-pixel, a second sub-pixel, and a third sub-pixel; and a plurality of pixel dots, each comprising a plurality of sub-pixels from two adjacent rows of sub-pixels in the pixel array, wherein the sub-pixels in any two of the adjacent rows of sub-pixels in the pixel array are shared by the any two of the adjacent rows of sub-pixels in the pixel array, wherein the plurality of pixel dots includes a first pixel dot and a plurality of second pixel dots adjacent to the first pixel dot, the first pixel dot includes a 2×3 matrix of sub-pixels and each of the plurality of second pixel dots includes a 2×3 matrix of sub-pixels, wherein the 2×3 matrix of sub-pixels of the first pixel dot includes two sub-pixels and four sub-pixels, each of the two sub-pixels is shared by a single second pixel dot of the plurality of second pixel dots, and each of the four sub-pixels is shared by three second pixel dots of the plurality of second pixel dots, wherein the pixel array includes a plurality of first pixel rows, a plurality of second pixel rows and a plurality of third pixel rows, wherein a first pixel row comprises a row of the first sub-pixel, the second sub-pixel, and a third sub-pixel, arranged in that repeated order, the second pixel row comprises a row of the third sub-pixel, the first sub-pixel, and the second sub-pixel arranged in that repeated order, and a third pixel row comprises a row of the second sub-pixel, the third sub-pixel, and the first sub-pixel arranged in that repeated order, and wherein in the pixel array, the first sub-pixel, the second sub-pixel and the third sub-pixel that are consecutively arranged in one of the first, the second and the third pixel rows include X number of virtual pixel dots and have a width of W, each sub-pixel has a length of one unit length, each of the X number of the virtual pixel dots has a length of one unit length and a width of Y, and W=X*Y, where Y=C/A, C denotes a constant which is 1 inch, A denotes pixel per inch, and $1<X\leq 3$, wherein each sub-pixel in the first pixel dot is shared by at least two virtual pixel dots, and each virtual pixel dot, containing a plurality of virtual sub-pixels, includes a partial portion of the first sub-pixel, the second sub-pixel and the third sub-pixel that are consecutively arranged, and wherein each sub-pixel in the first pixel dot includes a plurality of portions, each of the plurality of portions including a virtual sub-pixel corresponding to one of the plurality of second pixel dots adjacent to the first pixel dot, wherein the method comprises:

sharing at least one of the plurality of surrounding sub-pixels and the first sub-pixel in the first pixel dot, by sub-pixels in the one of the plurality of second pixel dots adjacent to the first pixel dot;

providing the first pixel dot with several sub-pixels of a same color, wherein a total luminance of the several sub-pixels of the same color is provided evenly by the several sub-pixels of the same color, and wherein the total luminance of the several sub-pixels of the same color is a sum of the luminance of the several sub-pixels of the same color;

providing sub-pixels of respective colors in the first pixel dot with the total luminance at a uniform ratio thereof to a highest luminance of the each sub-pixel of the respective colors, such that for each color, a ratio of the highest luminance of the sub-pixels to the total luminance of the sub-pixels is the same as the corresponding ratio for the other colors;

providing several additional second pixel dots adjacent to the first pixel dot to surround the first pixel dot, wherein the sub-pixels in the first pixel dot and sub-pixels in one of the several additional second pixel dots adjacent to the first pixel dot are shared by the first pixel dot and the one of the several additional second pixel dots adjacent to the first pixel dot; and inputting, by a signal driver, a signal to the each sub-pixel of the display panel, wherein the input signal is configured to control display luminance of the each sub-pixel, wherein the display luminance of the each sub-pixel is a sum of a luminance of the each sub-pixel in the first pixel dot and a luminance of the each sub-pixel in the one of the several additional second pixel dots, and wherein the display luminance of the each sub-pixel is the maximum luminance thereof.

8. The pixel compensation method for the display panel according to claim 7, wherein a single sub-pixel in the pixel structure is shared twice or four times.

* * * * *